United States Patent [19]

Odhner et al.

[11] 4,401,845

[45] Aug. 30, 1983

[54] LOW SMOKE AND FLAME SPREAD CABLE CONSTRUCTION

[75] Inventors: Oliver R. Odhner, Limerick; Joseph W. Michaud, Devon, both of Pa.

[73] Assignee: Pennwalt Corporation, Philadelphia, Pa.

[21] Appl. No.: 296,102

[22] Filed: Aug. 26, 1981

[51] Int. Cl.[3] ..... H01B 7/02

[52] U.S. Cl. ..... 174/113 R; 174/110 FC; 174/121 A

[58] Field of Search ..... 174/120 R, 120 SR, 121 R, 174/121 A, 121 SR, 113 R, 110 FC; 428/365, 377, 422, 421

[56] References Cited

U.S. PATENT DOCUMENTS

| | | | |
|---|---|---|---|
| 2,539,329 | 1/1951 | Sanders | 117/65 |
| 2,691,694 | 10/1954 | Young | 174/121 R |
| 2,707,205 | 4/1955 | Abbott et al. | 174/120 R |
| 3,176,065 | 3/1965 | Alexander et al. | 174/110 |
| 3,269,862 | 9/1966 | Lanza et al. | 117/213 X |
| 3,303,270 | 6/1965 | Shelton, Jr. | 174/121 |
| 3,420,720 | 1/1969 | Hillman | 174/110 |
| 3,576,940 | 5/1971 | Stone | 174/113 |
| 3,582,518 | 6/1971 | Lyons | 260/41 |
| 3,609,217 | 9/1971 | Gaja | 174/120 SR |
| 3,692,924 | 9/1972 | Nye | 174/120 SR |
| 3,823,255 | 7/1974 | La Gase et al. | 174/113 R |
| 3,971,882 | 7/1976 | Alia | 174/110 SR |
| 4,000,348 | 12/1976 | Harlow | 174/110 FC X |
| 4,079,191 | 3/1978 | Robertson | 174/121 SR |
| 4,150,249 | 4/1979 | Pedersen | 174/121 A X |
| 4,273,829 | 6/1981 | Perreault | 174/120 X |

FOREIGN PATENT DOCUMENTS

| | | | |
|---|---|---|---|
| 2335021 | 8/1977 | France | 174/121 A |

OTHER PUBLICATIONS

Brochure "TEFLON ® FEP Telephone Cable"; Berk-Tek, Inc.

Dukert, A. A., and Hall, N. T.; "The Characteristics of Kynar Polyvinylidene Fluoride as an Insulating Material" Wire and Wire Products, Feb. 1964.

Brochure "HALAR ® Firecurb" Plenum Cable; Allied Chemical, 1980.

Brochure "Plenum Cable of TEFLON ® FEP Fluorocarbon"; Dupont E26403.

Brochure "Fire Alarm Cable", Hi Temp Wires Inc.

*Primary Examiner*—A. T. Grimley
*Assistant Examiner*—Morris H. Nimmo

[57] ABSTRACT

A jacketed electrical cable construction has low smoke and flame spread characteristics so that it is suitable for use in plenum air spaces in buildings with drop ceilings without the need for metal conduits. The cable includes a bundle of conductors which are insulated with poly(vinylidene fluoride), a wrapping of poly(tetrafluoroethylene) impregnated glass tape surrounding the bundle of conductors and a jacket of poly(vinylidene fluoride).

6 Claims, 1 Drawing Figure

LOW SMOKE AND FLAME SPREAD CABLE CONSTRUCTION

BACKGROUND OF THE INVENTION

This invention relates generally to plastic jacketed electrical cables and more specifically to a cable construction employing poly(vinylidene fluoride) resin materials.

Plenum cables are electrical power and signal carrying cables which are located in the air spaces between the floors of buildings and suspended ceilings beneath the floors. Because these air spaces normally are continuous, if flammable materials are employed in electrical cable construction, the cables can contribute to the rapid spread of fire and smoke throughout the entire floor of the building. Therefore, where flammable materials are included, the cables must be encased in metal conduits, which are expensive. Polyfluorinated resins such as fluorinated ethylene propylene (FEP) have been employed to provide flame-resistant and low-smoke producing coatings so that metal conduits are not required. We have now found a polyfluorinated resin containing cable construction which has exceptionally low flame spread and smoke production properties so that such cables are especially suited for use in plenum cable systems.

BRIEF SUMMARY OF THE INVENTION

In accordance with this invention, there is provided a jacketed cable comprising a bundle of conductors having insulating layers including a poly(vinylidene fluoride) resin, a wrapping of a fluorinated polymer impregnated glass tape on the bundle, and a jacket of poly(vinylidene fluoride) resin.

DETAILED DESCRIPTION

Figure 1:
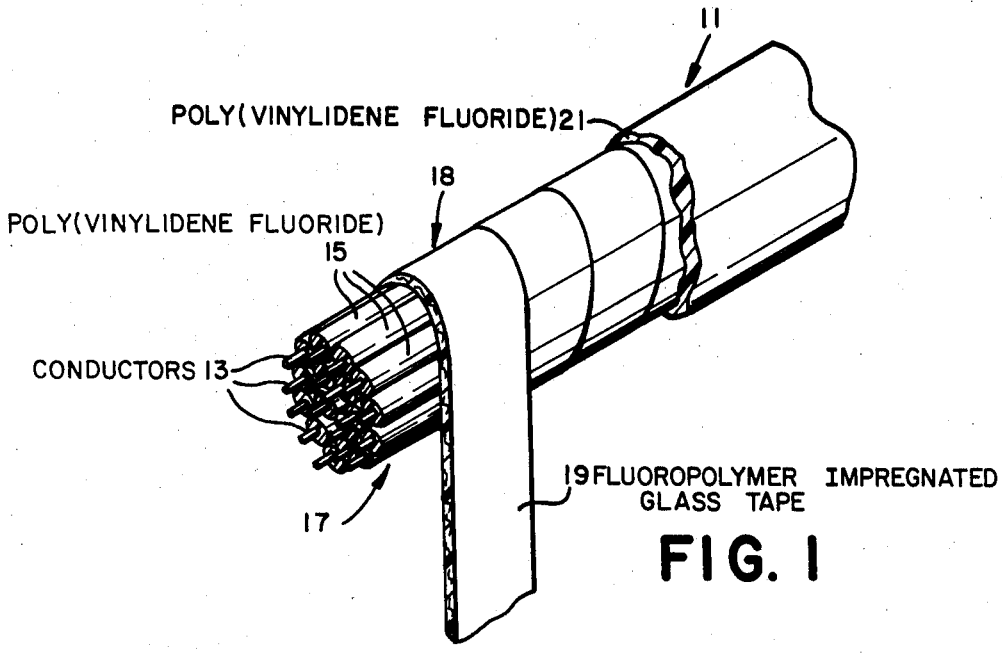
FIG. 1 is an elevational side view, with parts broken away, of an embodiment of the cable of the invention.

The cable construction of the invention employs poly(vinylidene fluoride) (PVDF) resin in combination with a glass wrapping tape which construction provides a flame retardant and low smoke electrical cable. The electrical cable, as illustrated in FIG. 1, generally comprises a plurality of individual electrical conductors 13 of, for example, copper or aluminum which each have an insulating layer 15 of polymer so that they are electrically insulated from one another. These wires are twisted into a bundle 17 and the bundle 17 is held together to form core 18 by a wrapping of tape 19. Tape 19 is of a polyfluorocarbon resin-impregnated silica glass. A glass tape of "E-glass" impregnated with 30 weight percent poly(tetrafluoroethylene) (PTFE) has been found to be particulary suitable. Such materials are commercially available for use as cable wrapping and besides holding the bundle together, perform the additional function of protecting the conductor insulating layers 15 where the cable jacket 21 is formed of a higher melting resin. The jacket 21 is then formed such as by extrusion using a cross head. The polymer insulating and jacket layers are formed of a poly(vinylidene fluoride) resin. Weight ratios of poly(vinylidene fluoride) polymer to impregnated glass tape of from about 6 to 1 to about 33 to 1 have been successfully employed. Ratios greater than 33 to 1 would be expected to produce increased smoke and flame spread. Exceptional low smoke generation properties and low flame spread are obtained when the ratio is about 22 to 1. The reason for the surprisingly better flame spread and smoke generation properties is not completely understood but it is believed that the property of HF generation by poly(vinylidene fluoride) polymers at high temperatures combined with absorption of HF by the silica glass tape may be involved. Other fluorinated polymers which have been employed in cable construction such as poly(tetrafluoroethylene) (PTFE) and fluorinated ethylene propylene (FEP) polymers do not have the property of releasing HF. The low flame spread evidenced by the cable construction of the invention is even more surprising considering the fact that poly(vinylidene fluoride) has a limiting oxygen index value (LOI) (ASTM D 2863) of about 44 as opposed to 95 for poly(tetrafluoroethylene) and fluorinated ethylene-propylene polymers. Because of the significantly lower LOI of poly(vinylidene fluoride), the flame spread properties of the cables of the invention would be expected to be inferior rather than superior to a cable including PTFE and FEP polymers as jacket and insulating layers.

Although the specific examples of cable described herein employ poly(vinylidene fluoride) homopolymer, it should be understood that cable constructions employing copolymers containing a major portion of vinylidene fluoride and possessing superior smoke and flame spread properties are considered to be within the scope of the invention. The term "poly(vinylidene fluoride) resin" as used herein encompasses such copolymers. The polymers can also contain minor amounts of additives such as pigments, plasticizers and extrusion aids.

In order to further illustrate the cable construction of the invention and compare its smoke generation and flame spread properties with other cable constructions, a series of cables were made and tested as described in the following examples:

EXAMPLE I

A telephone cable construction containing 25 pair of conductors was manufactured by the following steps:

1. Copper wire of 22 AWG was coated with KYNAR ® 460 grade poly(vinylidene fluoride) resin manufactured by Pennwalt Corporation containing 5 parts by weight per hundred parts by weight of resin of color concentrate which was added for identification. The wire was coated by the method known in the art as pressure extrusion. The insulation thickness was 10 mils average with an 8 mil minimum.

2. Two insulated wires made by Step 1 were twisted together with a 3 inch lay where the lay is defined as the degree of twist or the length measured along the axis of a wire or cable required for a single strand of wire to make one complete turn about the axis.

3. 25 pair of wires twisted in Step 2 were then twisted together to form a bundle with a 12 inch lay.

4. The bundle made by Step 3 was wrapped with a glass tape (E-glass cloth impregnated with PTFE resin). The tape was 0.025 inch thick and 1½ inches wide. The glass tape is available commercially under the trademark FLUOROGLASS ®, a product of Oak Materials Group, Inc. The tape was wrapped on the wire bundle with a 1.78 inch lay and ½ inch overlay. The E glass composition is approximately, in weight %: $SiO_2$ 54%, $Al_2O_3$ 14%, $B_2O_3$ 10%, MgO 4.5% and CaO 17.5%.

The PTFE resin comprises about 30 weight percent of the total weight of impregnated tape.

5. The core made by Step 4 was jacketed by a process known in the art as tubing extrusion coating using KYNAR 460 grade poly(vinylidene fluoride) resin containing 1-2 parts per hundred by weight of extrusion aid (which is a resin consisting of, by weight, 99% KYNAR 460 grade resin and 1% polytetrafluoroethylene resin) and 1 part per hundred by weight of color concentrate. The wall thickness of the jacket was 0.045 inch average and a minimum of 0.027 inch. The weight ratio of total poly(vinylidene fluoride) to glass tape in this construction was calculated to be about 22 to 1 with the weight of resin in the cable being about 29.5 gms/ft.

EXAMPLE 2 (COMPARISON)

The same cable construction was produced as in Example 1 except for Step 4 where the tape used was a MYLAR® (Du Pont) polyester film tape 0.001 inch thick and 1¼ inch wide.

EXAMPLE 3 (COMPARISON)

The same cable construction was produced as in Example 2 except fluorinated ethylene propylene polymer insulated conductor was made in Step 1.

EXAMPLE 4 (COMPARISON)

The same cable construction as Example 1 was product except fluorinated ethylene propylene polymer was used for the jacket instead of poly(vinylidene fluoride).

EXAMPLE 5 (COMPARISON)

A power limited fire protective signalling cable was constructed having 24 conductors of No. 22 AWG wire employing a KYNAR 460 grade resin insulation and jacket. The jacket was applied over MYLAR polyester tape which was 0.001 inch thick and 1.2 inches wide with a lap of ½ inch applied over the conductor assembly.

EXAMPLE 6

The same construction as Example 5 was produced except that the PTFE impregnated E-glass binder tape as described in Example 1 was used instead of the MYLAR polyester tape. The weight ratio of KYNAR resin to glass tape was calculated to be about 33 to 1 with the weight of resin in the cable being about 33 gms/ft.

Samples of cables prepared by Examples 1-6 were tested by a modified Steiner Tunnel test UL 723 (ASTM E84). Comparison samples of polyvinyl chloride insulated and jacketed cable were tested in both steel and aluminum conduits for control purposes.

The Steiner Tunnel test was modified to adapt the UL 723 test procedure to adequately test cables. The standard flame and draft conditions were used (240 fpm in the direction of flame growth and a 300,000 Btu/hr 4½ foot long methane igniting flame). The duration of the test was chosen as 20 minutes and the sample cables were supported on a 12 inch wide cable rack in the zone of maximum temperature and heat concentraton in a single layer which completely filled the rack width. The maximum flame spread was recorded rather than a flame spread factor. The smoke development was monitored by a photometer system in the test furnace exhaust duct and the optical smoke density was calculated from the light attenuation values. The results are given in Table I below:

TABLE I

| Cable Const. | No. of Cables | Conduit Type | No. of Conduits | Maximum Flame Spread(ft) | Optical Smoke Density Peak | Optical Smoke Density Average |
|---|---|---|---|---|---|---|
| Ex. 1 | 23 | none | — | 2.0 | 0.02 | 0.01 |
| Ex. 1 | 23 | none | — | 2.0 | 0.007 | 0.002 |
| Ex. 2 | 23 | none | — | 3.0 | 0.14 | 0.05 |
| Ex. 2 | 23 | none | — | 4.0 | 0.41 | 0.09 |
| Ex. 2 | 23 | none | — | 3.0 | 0.18 | 0.06 |
| Ex. 3 | 23 | none | — | 3.0 | 0.26 | 0.07 |
| Ex. 4 | 23 | none | — | 3.5 | 0.13 | 0.04 |
| Ex. 5 | 25 | none | — | 3.5 | 0.26 | 0.09 |
| Ex. 5 | 25 | none | — | 3.5 | 0.19 | 0.07 |
| Ex. 6 | 25 | none | — | 3.5 | 0.17 | 0.06 |
| Ex. 6 | 25 | none | — | 3.5 | 0.14 | 0.05 |
| PVC Control | 25 | steel | 5 | 7.0 | 2+ | 0.52+ |
| PVC Control | 25 | steel | 5 | 7.0 | 2+ | 0.52+ |
| PVC Control | 25 | aluminum | 5 | 4.5 | 0.91 | 0.22 |
| PVC Control | 25 | aluminum | 5 | 4.0 | 0.98 | 0.25 |
| PVC Control | 10 | aluminum | 10 | 3.5 | 0.85 | 0.14 |
| PVC Control | 10 | aluminum | 10 | 3.5 | 0.87 | 0.15 |

It can be seen from the results reported in Table I that the preferred cable construction of Example 1 at about a 22 to 1 PVDF to glass resin ratio had surprisingly lower flame spread than the other samples and produced little smoke. The cable construction of Example 6 at a 33 to 1 PVDF to glass resin ratio was measurably better than the comparable cable construction of Example 5, which used polyester tape, with respect to smoke generation and was comparable in flame spread. The cable construction of Example 1 was also superior to the average reported values for comparable cables formed with an FEP resin insulation and jacket (3.0 ft. flame spread and 0.30 optical peak for smoke generation) and ECTFE (copolymer of ethylene and chlorotrifluoroethylene resin insulation and jacket (4.0 ft. flame spread and 0.215 optical peak for smoke generation).

EXAMPLE 7 (COMPARISON)

A two pair telephone cable was prepared by coating copper wire of 22 AWG with KYNAR 460 grade resin insulaton and jacket. The jacket was applied over MYLAR polyester tape which was 0.0025 inch thick and 1.5 inches wide applied over the conductor assembly.

EXAMPLE 8

The same construction as Example 7 was produced except that the PTFE impregnated E-glass binder tape as described in Example 1 was used instead of the MYLAR polyester tape. The weight ratio of KYNAR resin to glass tape was calculated to be about 6 to 1 with the weight of resin in the cable being about 5 gms/ft.

Samples of cables prepared by Examples 7 and 8 were tested by the modified Tunnel test with about 65 lengths used to fill the rack. In two tests, the cables of Example 7 gave flame spreads of 3.0 and 3.5 feet, average optical smoke densities of 0.03 and 0.04 and smoke peaks of 0.12 and 0.25 respectively. In two tests, the cables of Example 8 gave flame spreads of 2.0 and 2.5 feet, average optical smoke densities of 0.02 and 0.02 and peaks of 0.08 and 0.10 respectively, thus demonstrating that for the cable configuration having two pairs of conductors the construction using glass tape was superior to the comparable one using polyester tape both with respect to smoke generation and flame spread. Because of the smaller cable diameter in these examples, the mass of resin in the rack was only about 325 gms/ft (65 cables×5 gms/ft per cable) compared to from about 675 to 825 gms/ft for the tests of the cable of Examples 1–6 so that the smoke results for Examples 7 and 8 would be expected to be lower than those of Examples 1–6 because of a smaller mass of resin being subjected to the flame.

We claim:

1. A low smoke and flame retardant jacketed cable comprising a bundle of conductors having insulating layers comprised of a poly(vinylidene fluoride) resin, a wrapping which includes a fluorinated polymer impregnated glass tape on said bundle, and a polymer jacket comprising a poly(vinylidene fluoride) resin wherein the weight ratio of total poly(vinylidene fluoride) resin to fluorinated polymer impregnated glass tape in said cable is from about 6 to 1 to about 33 to 1.

2. The cable of claim 1 wherein the weight ration of poly(vinylidene fluoride) resin to fluorinated polymer impregnated glass tape is about 33 to 1.

3. The cable of claim 1 wherein the weight ratio of poly(vinylidene fluoride) resin to fluorinated polymer impregenated glass tape is about 22 to 1.

4. The cable of claim 1 wherein the insulating layers and polymer jacket comprise poly(vinylidene fluoride) homopolymers and pigment.

5. The cable of claim 1 wherein the glass tape comprises a silica glass impregnated with a poly(tetrafluoroethylene) resin.

6. The jacketed cable of claim 1 wherein the cable has a maximum flame spread of about 2 feet and a maximum peak optical smoke density of about 0.02 as determined by the modified Steiner Tunnel test UL 723 (ASTM E-84) when the mass of resin in the test is about 675 gms/ft.

* * * * *